US005443145A

United States Patent [19]

Schoeneweiss

[11] Patent Number: 5,443,145

[45] Date of Patent: Aug. 22, 1995

[54] SAFETY DEVICE AT THE RUN-IN POINT OF A CIRCULATING HANDRAIL

[75] Inventor: Klaus Schoeneweiss, Hattingen, Germany

[73] Assignee: O&K Orenstein & Koppel, AG, Berlin, Germany

[21] Appl. No.: 244,256

[22] PCT Filed: Jun. 9, 1993

[86] PCT No.: PCT/EP93/01456

§ 371 Date: Aug. 19, 1994

§ 102(e) Date: Aug. 19, 1994

[87] PCT Pub. No.: WO94/05585

PCT Pub. Date: Mar. 1, 1994

[30] Foreign Application Priority Data

Sep. 8, 1992 [DE] Germany ..... 42 29 936.5

[51] Int. Cl.[6] ..... B66B 29/04

[52] U.S. Cl. ..... 198/323; 198/338

[58] Field of Search ..... 198/323, 338

[56] References Cited

U.S. PATENT DOCUMENTS

| | | | |
|---|---|---|---|
| 2,846,045 | 8/1958 | Fowler | 198/323 |
| 3,809,206 | 5/1974 | Bredehorn et al. | 198/323 |
| 3,835,977 | 9/1974 | Hewitt et al. | 198/323 |
| 3,934,699 | 1/1976 | Saito et al. . | |
| 3,935,977 | 2/1976 | Bonnett . | |
| 4,619,355 | 10/1986 | Adrian et al. | 198/323 |
| 4,915,207 | 4/1990 | Henning . | |
| 4,924,995 | 5/1990 | Adrian et al. | 198/323 |
| 4,976,345 | 12/1990 | Adrian et al. | 198/323 |

FOREIGN PATENT DOCUMENTS

| | | | |
|---|---|---|---|
| 1169629 | 5/1964 | Germany . | |
| 2054640 | 5/1972 | Germany . | |
| 2409985 | 9/1974 | Germany . | |
| 0604787 | 4/1978 | U.S.S.R. | 198/338 |

*Primary Examiner*—D. Glenn Dayoan
*Attorney, Agent, or Firm*—Spencer, Frank & Schneider

[57] ABSTRACT

A safety device is disposed at a run-in region of a circulating handrail of a moving passage into a stationary wall. The safety device is made of a cover plate; an elastically deformable handrail run-in part configured as a bellows and connected to the cover plate; a rod-shaped element having a first end and a second end and being seated in a rear region of the handrail run-in part; an angled component having a first leg connected to a rear side of the handrail run-in part and a second leg adapted to receive the first end of the rod-shaped element; and a limit switch for stopping a movement of the moving passage upon being activated. The limit switch is disposed such that the rod-shaped element is effective for transmitting a deformation of the handrail run-in part onto the limit switch for activating the limit switch.

12 Claims, 1 Drawing Sheet

SAFETY DEVICE AT THE RUN-IN POINT OF A CIRCULATING HANDRAIL

BACKGROUND OF THE INVENTION

The invention relates to a safety device at the run-in point of a circulating handrail of an escalator, a moving walkway, or a like moving passage, into a stationary wall.

In the region of the run-in point of the circulating handrail, escalators and moving walkways have a safety device that has shown that persons riding on an escalator, particularly children, hold the handrail until their hand reaches the run-in point of the handrail into the stationary wall. In such a case it can occur that the fingers are pulled into the gap located between the surface of the handrail and the run-in opening in the wall. Without certain safety measures, therefore, the danger exists of serious injuries.

To avoid such injuries, in DE-PS 2,054,640 a safety device is proposed which uses a plurality of plates pivotably disposed at the run-in points and structured in the manner of flaps. If the handrail is also still held by a person in the region of the run-in point, the touching of the plates by the fingers leads to their pivoting, by means of which the contact of a safety switch for shutting down the escalator is activated. To prevent mischievous spurious release of the safety device by means of an undesired activation of the plates, it is further provided in the known safety device to use respectively two pivotable plates disposed one behind the other with small spacing. In this instance the spacing between the handrail and the inside edge of the first plate is dimensioned to be so large that the fingers can extend into this gap without injury. Not until one of the two rear plates is touched is the common safety switch activated, and at the same time, the still-closed first plate is unlocked. This known safety device meets high requirements with respect to safety and protection against spurious releases; however, it is expensively composed of a number of parts. To transmit the pivoting movement of the plates onto the contact of the safety switch, activation means provided with a run-on edge are required whose adjustment must be undertaken exactly with respect to all of the plates, on the one hand, and with respect to the contact of the safety switch, on the other hand, in order to assure the desired function. Even slight deviations from the provided settings can lead to the front plate being unlocked too late, because of which injuries can occur.

SUMMARY OF THE INVENTION

The goal of the subject of the invention is the creation of a safety device for emergency stop of the drive when objects (fingers or the like) enter into the handrail run-in, in which case shutdown is intended to take place, even with a ruptured or slack handrail. The safety device should be simply designed and easily accessible.

This goal is achieved by means of an elastically deformable handrail run-in part in whose rear region a rod-shaped element which transmits the deformation of the handrail run-in part onto a limit switch is seated by means of connecting elements.

Advantageous modifications of the subject of the invention are to be taken from the dependent claims.

As a consequence of the elasticity of the handrail run-in in connection with the one rod which converts the buckling of the elastic part into a longitudinal movement, the downstream limit switch can already be activated in time, so that a danger for people can be excluded to the fullest extent. The same applies for objects that intentionally or unintentionally enter the handrail run-in and can possibly lead to damage of escalator components. To provide a delayed reaction time of the safety device with simple means, the course of movement of the rods is influenced by a mechanically prestressable prestressing device. This means that the limit switch is first activated with the occurrence of a force having a predetermined effect on the elastic region of the handrail run-in. With this measure it can be ensured that the escalator or the moving walkway is not subjected to emergency shutdown with each possible, unintended touching of the elastic handrail run-in.

The safety device is simply designed and easily accessible, and the mechanical prestress of the prestress device can be set or adjusted without problems.

BRIEF DESCRIPTION OF THE DRAWINGS

The invention is represented in the drawing by way of an embodiment, and described in the following manner.

DETAILED DESCRIPTION OF THE INVENTION

Figure 2:
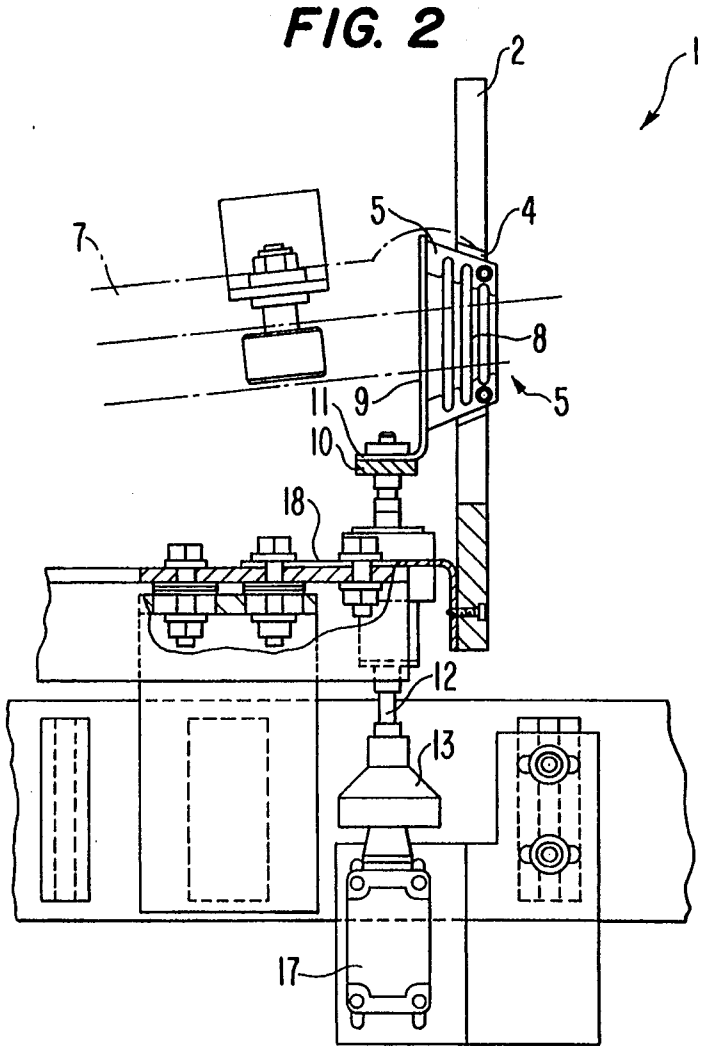
FIG. 2 shows a cross-sectional view of the device of FIG. 1 in a plane parallel to the direction of movement of the handrail.
Figure 1:
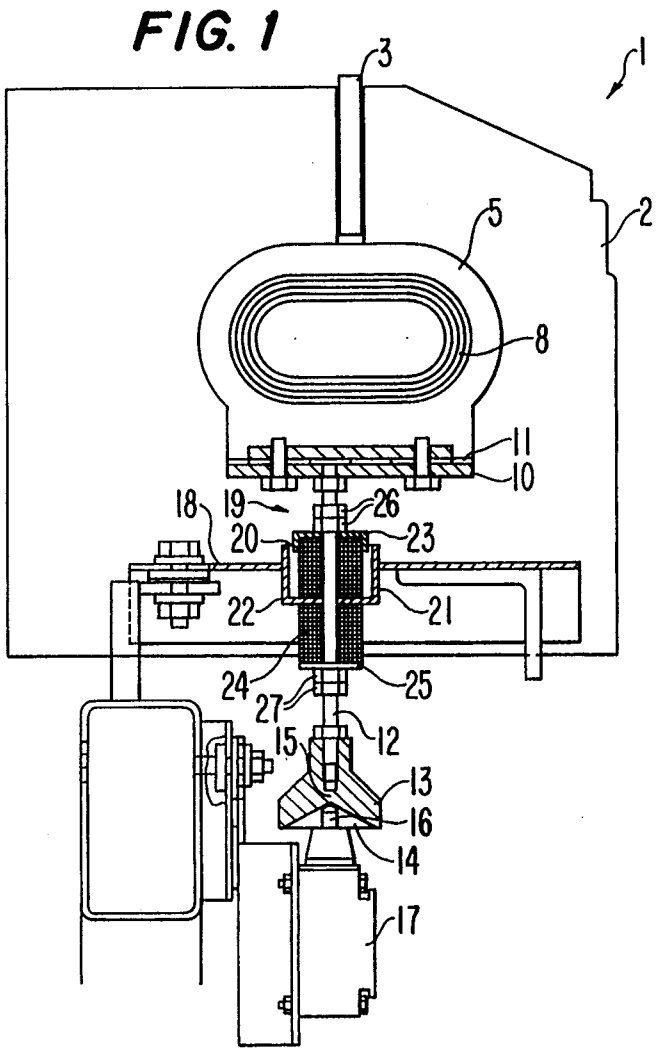
FIG. 1 shows a cross-sectional view of the safety device in a plane perpendicular to the direction of movement of the handrail.

The safety device 1 is provided in the region of an end plate 1 or cover plate 2 of an escalator wall not shown further. Only indicated is the balustrade 3 in the form of a glass disk. A recess 4, which serves to receive a handrail run-in part 5, is provided in the region of the end plate 2. In the region of the run-in point 6 for the handrail 7, only indicated here, the handrail run-in part 5 is provided with an elastic bellows 8, which is provided in its back region with an angled component 9. By way of an intermediate plate 10 as a connecting element, a rod 12 is connected to the free leg 11 of the component 9, which rod has in its free end region a switching slide 13, which is in turn configured with a conically-tapering recess 14 whose tip 15 lies on the plunger 16 of a limit switch 17. The rod 12 is disposed essentially vertically and is guided opposite the end plate 2 by means of further connecting elements 18, which are in turn screwed to the end plate 2. The further connecting elements 18 include a guide 19, which is provided for receiving a rubber spring element 20. The rubber spring element 20 is encompassed by a lateral 21 and a lower defining wall 22, and a cup-shaped plate 23 rests on the rubber spring 20. A further rubber spring 24, whose one end face lies against the bottom 22 and whose free end face cooperates with a plate-shaped element 25 is provided beneath the bottom 22. The rod 12 is provided with a thread, so that the rubber springs 20, 24 can be tensioned counter to one another, i.e. against the bottom 22 of the guide 19, by means of corresponding nuts 26, 27 in order to be able to influence the motion inertia of the rod 12. The safety device 1 thus first reacts when a predetermined pressure acts on the bellows 8, so that it is ensured that the emergency shutdown of the escalator is not effected with each possibly undesired touching of the bellows 8. As a consequence of the force acting on the bellows 8, the bellows is pressed together, and as a consequence of this pressing process a change in the length of the rod 12 is caused, with corresponding triggering of the limit switch.

What is claimed is:

1. A safety device disposed at a run-in region of a circulating handrail of a moving passage into a stationary wall, the safety device comprising:

a cover plate;

an elastically deformable handrail run-in part configured as a bellows and connected to the cover plate;

a rod-shaped element having a first end and a second end and being seated in a rear region of the handrail run-in part;

an angled component having a first leg connected to a rear side of the handrail run-in part and a second leg adapted to receive the first end of the rod-shaped element; and a limit switch for stopping a movement of the moving passage upon being activated, the limit switch being disposed such that the rod-shaped element is effective for transmitting a deformation of the handrail run-in part onto the limit switch for activating the limit switch.

2. The-safety device according to claim 1, wherein the handrail run-in part is connected to the first end of the rod-shaped element by a connecting element.

3. The safety device according to claim 1, wherein the rod-shaped element is disposed essentially vertically and has a switching slide disposed at its second end.

4. The safety device according to claim 1, wherein the rod-shaped element is guided vertically.

5. The safety device according to claim 2, wherein the rod-shaped element is guided opposite the cover plate by further connecting elements.

6. The safety device according to claim 5, further comprising a prestressing device arranged in the region of the further connecting elements for influencing the motion inertia of the rod-shaped element.

7. The safety device according to claim 6, wherein the prestressing device comprises a plurality of rubber springs which encompass the rod-shaped element and which can be tensioned counter to one another in the axial direction and against the further connecting elements.

8. The safety device according to claim 7, wherein the plurality of rubber springs includes a first rubber spring and a second rubber spring, and wherein the further connecting elements include a guide encompassing the first rubber spring laterally and on a bottom region of the first rubber spring.

9. The safety device according to claim 8, wherein the second rubber spring underlies the first rubber spring and is tensionable against a bottom region of the guide.

10. The safety device according to claim 5, wherein the rod-shaped element includes a thread on at least a portion thereof, and wherein a fastening of the rod-shaped element with respect to the further connecting elements is effected by a first set of screw nuts.

11. The safety device according to claim 3, wherein the limit switch includes a plunger at one end thereof, and wherein the switching slide includes a recess which lies on the plunger of the limit switch.

12. The safety device according to claim 10, wherein the prestressing device comprises a plurality of rubber springs which encompass the rod-shaped element and which can be tensioned counter to one another in the axial direction and against the first connecting elements by a second set of screw nuts which cooperate with tensioning plates disposed at their free end faces.

* * * * *